US009719195B1

(12) United States Patent
Goldberg

(10) Patent No.: US 9,719,195 B1
(45) **Date of Patent: *Aug. 1, 2017**

(54) INSULATING SHEER FABRIC

(71) Applicant: Smart Textile Products, LLC, Warwick, RI (US)

(72) Inventor: Gary Goldberg, Providence, RI (US)

(73) Assignee: Smart Textile Products, LLC, Warwick, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/484,596

(22) Filed: Apr. 11, 2017

Related U.S. Application Data

(63) Continuation of application No. 15/358,416, filed on Nov. 22, 2016, which is a continuation of application No. 15/132,652, filed on Apr. 19, 2016, now Pat. No. 9,528,201.

(60) Provisional application No. 62/191,757, filed on Jul. 13, 2015.

(51) Int. Cl.
*D03D 13/00* (2006.01)
*D03D 1/00* (2006.01)
*D03D 15/00* (2006.01)

(52) U.S. Cl.
CPC ..... *D03D 1/0017* (2013.01); *D03D 13/004* (2013.01); *D03D 13/008* (2013.01); *D10B 2503/02* (2013.01)

(58) Field of Classification Search
CPC ..... D03D 15/00; D03D 9/00; D03D 13/008; D03D 1/007; D03D 13/004; D03D 23/00
See application file for complete search history.

(56) References Cited

U.S. PATENT DOCUMENTS 1,983,617 A * 12/1934 Ladon ..... E04B 1/78 139/425 R
2,774,421 A * 12/1956 Lion ..... A47H 23/08 160/238
2,817,371 A * 12/1957 Bussiere ..... D03D 23/00 139/383 R
3,417,794 A * 12/1968 Lynch ..... A01G 9/1438 139/420 C
4,002,188 A * 1/1977 Hanks ..... D03D 1/00 139/420 C
4,550,038 A * 10/1985 Becker ..... A47H 13/14 160/330
4,587,997 A * 5/1986 Brooks ..... D03D 9/00 139/420 R (Continued)

OTHER PUBLICATIONS

International Search Report and Written Opinion for Application No. PCT/US2016/042037, mailed Dec. 5, 2016.
[No Author Listed] Insulated SemiSheer, Lace & Voile Curtains—ThermaSheer, ThermaLace & ThermaVoile. http://www.thermalwindowcurtains.com/insulated-sheer-curtains [last accessed Jul. 19, 2016].

*Primary Examiner* — Bobby Muromoto, Jr.
(74) *Attorney, Agent, or Firm* — Wolf, Greenfield & Sacks, P.C.

(57) ABSTRACT

Fabrics which allow for light transmission and provide thermal insulation are described. A fabric is formed from at least one yarn to form a continuous web of fabric. The continuous web is configured to allow some incident light to be transmitted through the fabric, and to reduce heat transfer through the fabric. The continuous web of fabric may be a woven fabric where the at least one yarn is woven to form the woven fabric.

30 Claims, 8 Drawing Sheets

(56) References Cited

U.S. PATENT DOCUMENTS

| | | | | | |
|---|---|---|---|---|---|
| 4,623,281 | A * | 11/1986 | Verbauwhede | E02B 3/122 | 139/425 R |
| 4,861,651 | A * | 8/1989 | Goldenhersh | D06M 13/127 | 427/160 |
| 5,503,917 | A * | 4/1996 | Hughes | A41D 31/00 | 139/383 R |
| 6,037,280 | A * | 3/2000 | Edwards | D06M 11/44 | 139/383 R |
| 6,397,920 | B1 * | 6/2002 | Forin | D03D 9/00 | 139/383 R |
| 7,172,802 | B2 * | 2/2007 | Sutherland | D03D 9/00 | 139/417 |
| 7,481,251 | B2 * | 1/2009 | Lin | D03D 15/04 | 139/383 R |
| 8,193,105 | B2 * | 6/2012 | Goldberg | A47C 27/006 | 428/315.7 |
| 9,528,201 | B1 | 12/2016 | Goldberg | | |
| 2001/0037849 | A1 * | 11/2001 | Corey | B29C 66/437 | 156/73.4 |
| 2003/0186606 | A1 * | 10/2003 | Sutherland | D03D 9/00 | 442/301 |
| 2008/0096450 | A1 * | 4/2008 | Goldberg | A47C 27/006 | 442/181 |
| 2017/0016152 | A1 | 1/2017 | Goldberg | | |
| 2017/0073855 | A1 * | 3/2017 | Goldberg | D03D 1/0017 | |

* cited by examiner

INSULATING SHEER FABRIC

CROSS-REFERENCED TO RELATED APPLICATIONS

This application is a continuation of U.S. application Ser. No. 15/358,416 filed Nov. 22, 2016, entitled 'INSULATING SHEER FABRIC," which is a continuation of U.S. application Ser. No. 15/132,652 filed Apr. 19, 2016, entitled 'INSULATING SHEER FABRIC," which claims the benefit under 35 U.S.C. §119(e) to U.S. Provisional Application No. 62/191,757, entitled "INSULATING SHEER FABRIC" filed on Jul. 13, 2015, each of which is herein incorporated by reference in its entirety.

FIELD

Disclosed embodiments are related to fabrics that transmit light and provide thermal insulation.

BACKGROUND

Drapery fabrics are often used as both aesthetic and functional coverings for windows, doors, and other architectural openings. Some drapery fabrics provide thermal insulation to reduce the amount of heat that is transmitted into or out of a room. Other drapery fabrics such as sheer fabrics may be constructed to provide privacy while still allowing light to be transmitted into a room.

SUMMARY

In one embodiment, a woven fabric includes warp and filling yarns arranged in a weave pattern. The yarns and weave pattern configured to transmit between about 20% and about 65% of incident light through the fabric, as measured according to AATCC 203-2014. The weave pattern has a density between about 30 and about 130 warp threads per inch and between about 40 and about 120 filling threads per inch, as measured according to ASTM D3775.

In another embodiment, a woven fabric includes warp and filling yarns arranged in a weave pattern. The yarns and weave pattern configured to transmit between about 20% and about 65% of incident light through the fabric, as measured according to AATCC 203-2014. The weave pattern has a density between about 30 and about 130 warp threads per inch and between about 40 and about 120 filling threads per inch, as measured according to ASTM D3775. The warp and filling yarns are about 75 denier, as measured according to ASTM D1059.

In yet another embodiment, a woven fabric includes warp and filling yarns arranged in a weave pattern. The yarns and weave pattern configured to transmit between about 20% and about 65% of incident light through the fabric. The weave pattern has a density between about 30 and about 130 warp threads per inch and between about 40 and about 120 filling threads per inch, as measured according to ASTM D3775. The fabric has a bending length between about 2.00 cm and about 3.75 cm, as measured according to ASTM D1388.

In still another embodiment, a woven fabric includes warp and filling yarns arranged in a weave pattern. The yarns and weave pattern configured to transmit between about 20% and about 65% of incident light through the fabric. The weave pattern has a density between about 30 and about 130 warp threads per inch and between about 40 and about 120 filling threads per inch, as measured according to ASTM D3775. The fabric blocks transmission of between about 65% and 98% of ultraviolet light incident upon the fabric, as measured according to AATCC 183.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

In cases where the present specification and a document incorporated by reference include conflicting and/or inconsistent disclosure, the present specification shall control. If two or more documents incorporated by reference include conflicting and/or inconsistent disclosure with respect to each other, then the document having the later effective date shall control.

BRIEF DESCRIPTION OF DRAWINGS

The accompanying drawings are not intended to be drawn to scale. In the drawings, each identical or nearly identical component that is illustrated in various figures may be represented by a like numeral. For purposes of clarity, not every component may be labeled in every drawing. In the drawings.

DETAILED DESCRIPTION

The inventor has recognized and appreciated numerous drawbacks associated with conventional drapery fabrics. For example, typical thermally insulating fabrics are made from heavy materials that block the transmission of natural light, and therefore their use often necessitates the use of additional artificial lighting within a room in which thermal insulation is desired. In contrast, conventional sheer fabrics are made from materials having a more open structure to allow the transmission of light, but the open structure provides little thermal insulation. Some sheer fabrics employ a clear plastic material on one side of the fabric to improve the insulating properties while maintaining good light transmission. However, such a construction negatively impacts the soft tactile feel and visual appearance of the fabric.

In view of the above, the inventor has recognized numerous advantages associated with an insulating sheer fabric that provides thermal insulation without relying on a plastic coating, while also allowing the transmission of light through the fabric. Such a fabric may provide a desired amount of privacy from an exterior view, while allowing a meaningful amount of natural light to pass into a room. Further, the thermal insulation provided by the fabrics described herein may improve energy efficiency in a room by reducing the transmission of heat into or out of the room. Additionally, such a fabric provides the soft tactile feel and visual appearance of a sheer.

According to one aspect, an insulating sheer fabric includes a continuous web of fabric formed from at least one yarn; the continuous web may be formed by weaving, knitting, felting, knotting, or any other suitable process. The continuous web includes open spaces such as pores between strands of the yarn that are configured to allow light to pass through, such that the sheer fabric has a suitable level of light transmittance. Depending on the particular embodiment, an insulating sheer fabric may transmit between about 20% and about 65% of the light incident upon one side of the fabric. It should be understood that light transmission through an insulating sheer fabric as described herein generally refers to transmission of visible light (i.e., electromagnetic radiation with a wavelength between about 400 nm and about 700 nm).

Figure 1:
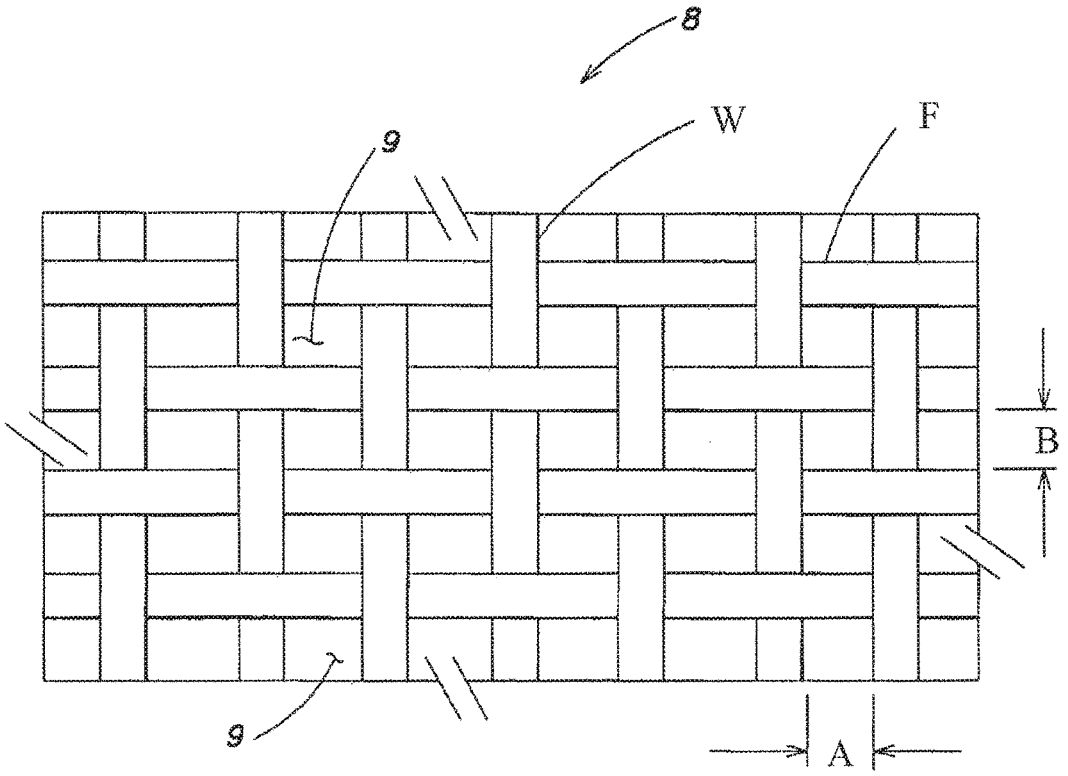
FIG. 1 is a schematic representation of a simple weave pattern showing an illustrative pore size.

FIG. 1 shows a schematic representation of a fabric 8 including a plurality of pores 9 between strands of yarn. As illustrated, the pore size, which may control the light transmittance of the fabric, is defined by the spacing between adjacent warp "W" yarns and/or filling "F" yarns. For example, a smaller spacing between warp and/or filling yarns (corresponding to a higher density of threads) may result in a smaller pores and an associated decrease in the overall light transmission through the fabric. The size of warp and/or filling yarns also may affect the pore size of a woven fabric. For example, using wider or larger diameter yarns may result in a decreased pore size for a given weave density, thereby reducing the overall light transmission through the fabric. Accordingly, the thread density and/or yarn size may be chosen to define a pore size that provides a suitable degree of light transmittance. As used herein, the term "yarn" or "yarns" may be used interchangeably with "thread", "threads", "fibers," or "filaments", respectively, as the present disclosure is not limited in this regard.

According to another aspect, the yarn weight and/or weave density of a fabric may be chosen such that the yarn fibers have sufficient mass to provide a suitable degree of thermal insulation. In some embodiments, the degree of thermal insulation provided by a layer of an insulating sheer fabric may be characterized by its R value. The R value of an insulating layer is herein defined as $R=\Delta T/\dot{Q}$, where $\Delta T$ is the temperature difference across the insulating layer, and $\dot{Q}$ is the heat flux through the layer. Therefore, the R value is a measure of the effective thermal resistance of the insulating layer. For example, for a predetermined temperature difference ($\Delta T$) across an insulating layer, such as between the interior side and exterior side of an opening, the R value may be used to calculate the amount of heat lost through the insulating layer as $\dot{Q}=\Delta T/R$. Accordingly, insulating layers with higher R values provide better insulation by reducing heat loss. Depending on the particular embodiment, an insulating sheer fabric may have an R value between about 0.75 $K\cdot m^2/W$ and 1.2 $K\cdot m^2/W$.

In some embodiments, an insulating sheer fabric may achieve the above-described light transmission and thermal insulation performance through a suitable choice of yarn and weave parameters to define a suitable construction of the fabric. For example, in one embodiment, an insulating sheer fabric includes a woven layer formed from a texturized polyester yarn of about 75 denier, as measured according to ASTM D1059, for both the warp and filling yarns. Such a yarn may allow for a consistent balance of fiber mass (to achieve thermal insulation) and light transmission through pores in the woven layer. In other embodiments, a non-spun yarn of between about 15 denier and about 500 denier may be used, or its equivalent in a spun yarn (e.g., a 10 singles to 100 singles). Further, it should be understood that the warp and filling yarns may have different weights or sizes. For example, in one embodiment, an insulating sheer fabric is formed from an about 38 denier warp yarn and an about 330 denier filling yarn. Depending on the particular embodiment, a warp and/or filling yarns may be made from synthetic materials including, but not limited to, polyester, polypropylene, nylon, glass, or aramids, or natural materials including, but not limited to, cotton, wool, or silk. However, it should be understood that other materials and/or yarn weights may be suitable, as the disclosure is not limited in this regard.

In one embodiment, a yarn is woven to form an insulating sheer fabric having a weave density of about 96 warp threads per inch and about 72 filling threads per inch as measured according to ASTM D3775. In another embodiment, the weave density may be between about 95 and 110 warp threads per inch and between about 68 and 75 filling threads per. In other embodiments, the weave density may be between about 30 and 130 warp threads per inch and between about 40 and 120 filling threads per inch. However, it should be understood that other weave densities may be suitable, as the disclosure is not so limited.

In one embodiment, an insulating sheer fabric has a finished woven weight of about 78.6 grams per square meter, as measured according to ASTM D3776. In other embodiments, the finished woven fabric has a weight between about 70 $g/m^2$ and 140 $g/m^2$, although it should be understood that other finished weights may be suitable, as the disclosure is not so limited.

According to a further aspect, the light transmittance and/or heat transfer through an insulating sheer fabric may depend on the pore size and/or pore size distribution of the fabric. As described above, the pore size may be defined by the spacing between adjacent warp yarns and filling yarns, which may depend on various aspects of the fabric construction including the weave density and/or yarn weight. In one embodiment, a fabric has a mean pore size of about 68 μm and a standard deviation in the pore size of about 46 μm. In another embodiment, a fabric has a mean pore size of about 69 μm and a standard deviation in the pore size of about 56 μm. In some embodiments, the thread density for the warp and filling yarns may be approximately equal, and in such embodiments, the pores may have a substantially square shape. Alternatively, a fabric may have a thread density that is different between the warp and filling yarns, and therefore the pores may have a rectangular shape with dimensions corresponding to the spacing of adjacent warp and filling yarns. Referring again to FIG. 1, a pore 9 has a generally rectangular shape with a first edge length A corresponding to the spacing between warp yarns and a second edge length B corresponding to the spacing between filling yarns. In some embodiments, the thread density may vary at different locations in a fabric such that the pore size varies across the fabric.

Depending on the particular embodiment, an insulating sheer fabric may be constructed to have an appropriate stiffness. For example, in drapery applications, a softer fabric with a smaller stiffness may be desirable to ensure that the fabric hangs in a suitable manner and provides a desired aesthetic appearance. Therefore, in some embodiments, an insulating sheer fabric as described herein may have a bending length between about 2.00 cm and about 3.75 cm as measured according to ASTM D1388.

Figure 2A:
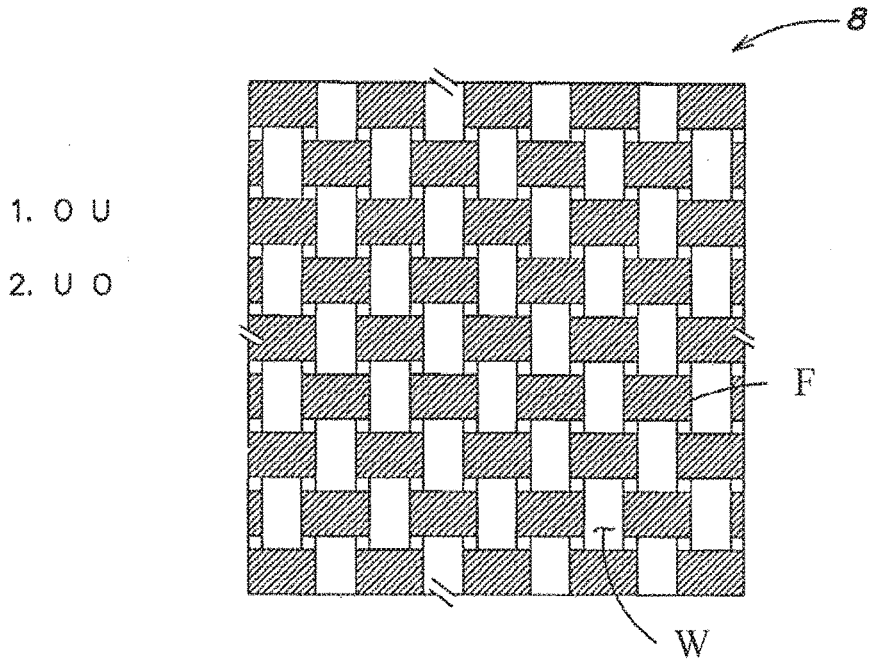
FIGS. 2*a*-2*g* are schematic representations of illustrative embodiments of various weave patterns.
Figure 2B:
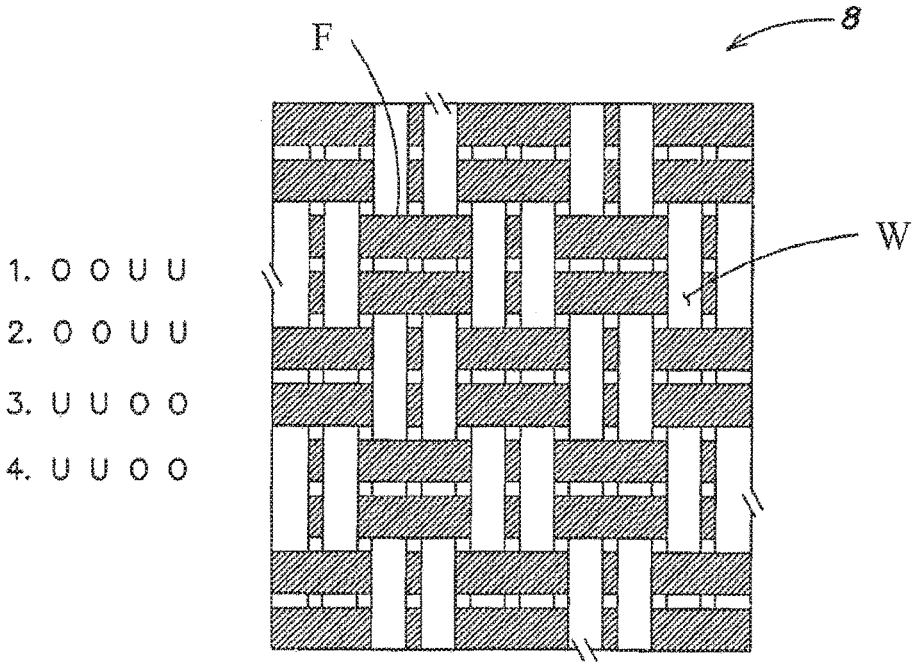
Figure 2C:
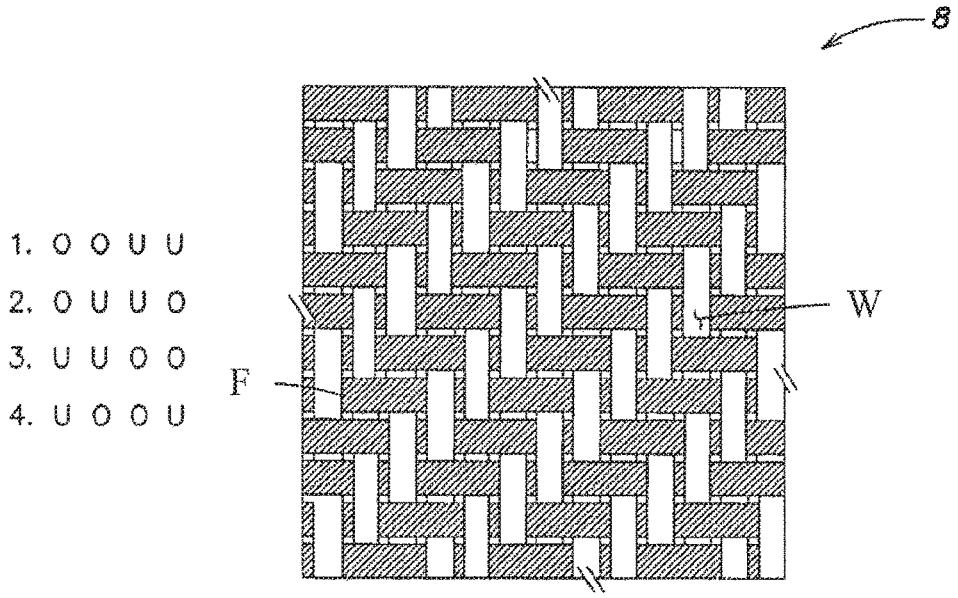
Figure 2D:
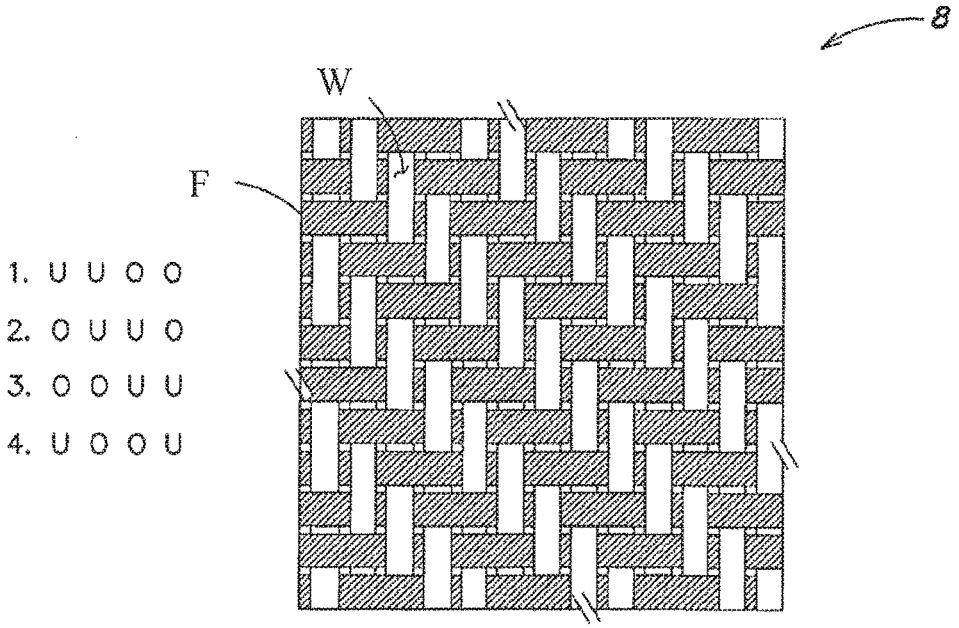
Figure 2E:
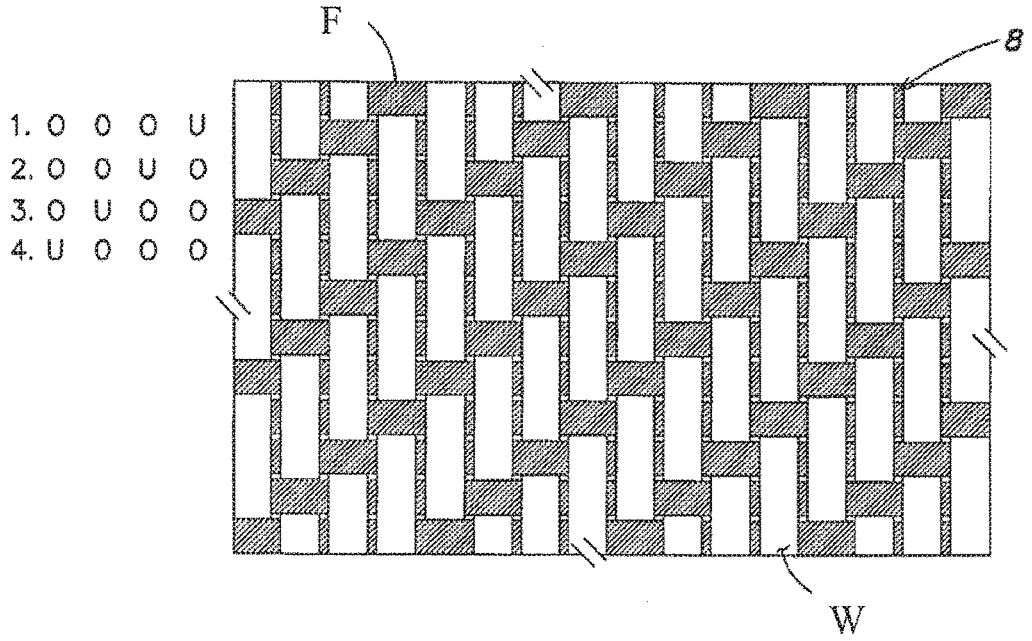
Figure 2F:
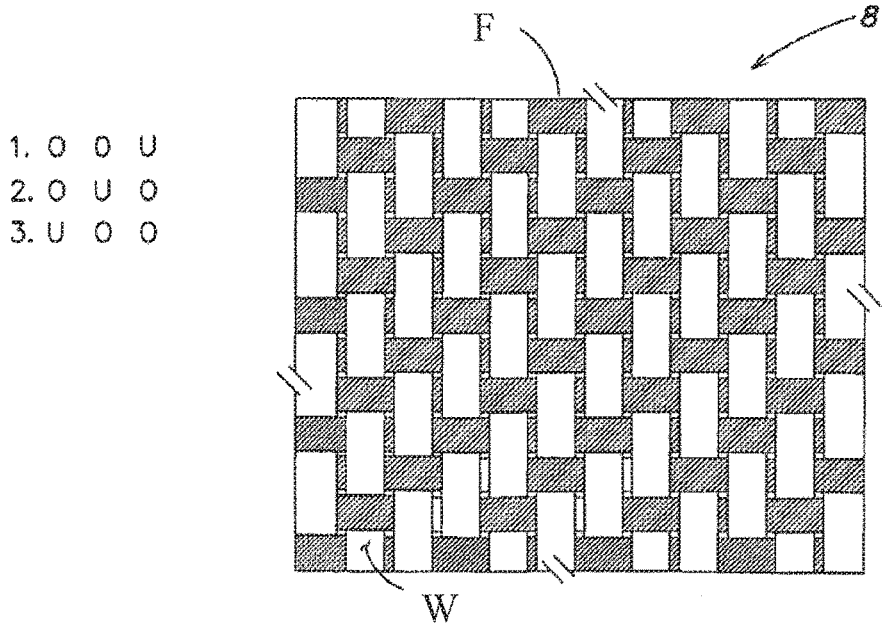
Figure 2G:
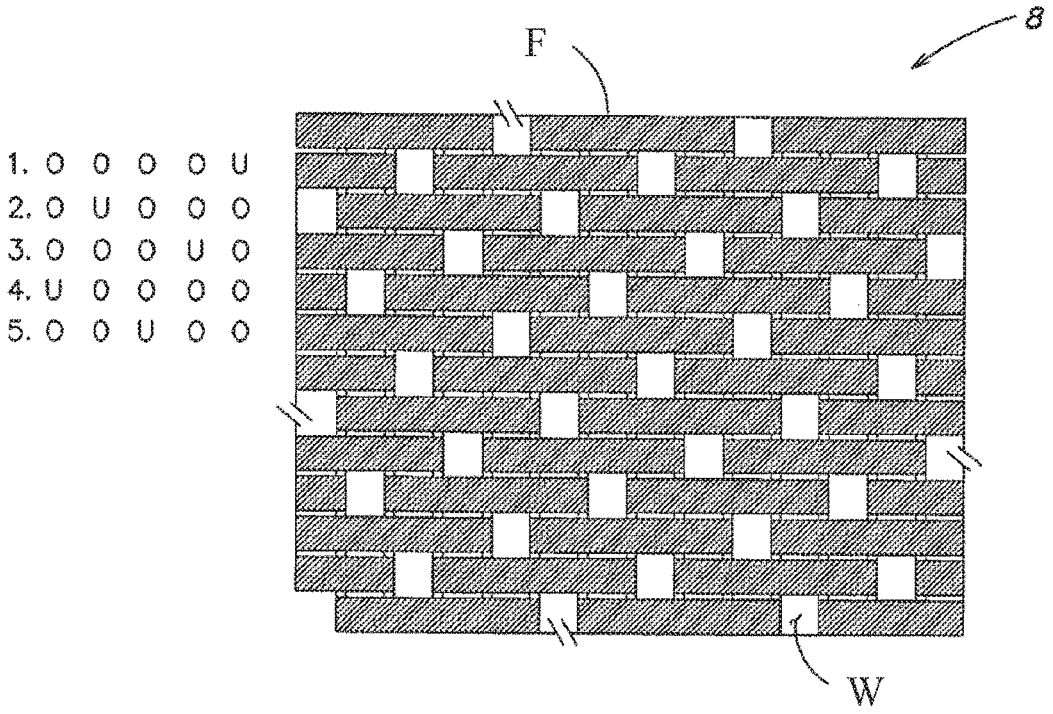

Referring now to FIGS. 2*a*-2*g*, illustrative embodiments of a woven fabric 8 are shown, along with the representative over ("O") and under ("U") tables associated with particular weave patterns. Yarns of any suitable material are woven together to produce a desired weave pattern. In the example shown in FIG. 2*a*, a plain weave (also referred to as a "tabby" or "linen weave") is illustrated wherein warp "W" and filling "F" yarns in a typical alternating over and under fashion is employed. It should be appreciated, however, that the present disclosure is not limited in this regard, as other weaving patterns or combinations of weaving patterns may be employed to form an insulating sheer fabric. For example, in the embodiment shown in FIG. 2*b*, two strands or threads in a side-by-side relationship, such as may be used in a basket weave, may be employed. Twill patterns may also be employed, where each filling thread proceeds in the same over/under pattern, but is offset by one thread from the previous filling thread. The under/over pattern of the twill is usually noted by two numbers with a slash between them, like 3/1. The number before the slash represents the quantity of threads a warp thread goes over, and the number after the slash is the amount of threads a warp thread goes under. Examples of such twill patterns are shown in FIG. 2*c* (showing a 2/2 Twill in a Z-wale pattern); FIG. 2*d* (showing a 2/2 Twill, S-wale); FIG. 2*e* (showing a 1/3 Twill, Z-wale); and FIG. 2*f* (showing a 1/2 Twill, Z-wale). FIG. 2*g* represents another alternative weave pattern, wherein a satin weave is used. Satin weaves typically employ a continuous filling yarn, with few interruptions of the warp yarn. Alternatively, voile weaves, jacquard weaves, or any other suitable woven pattern may be used. Furthermore, although woven fabrics are shown and described, knitted fabrics may be employed in some embodiments, as the present disclosure is not so limited. In this regard, it should be appreciated that the present disclosure is not limited to any particular way of producing a fabric from yarns or threads. Thus, any fabric formed in any suitable manner resulting in pores between adjacent individual threads or yarns (in the case of a woven fabric) or adjacent lines of threads or yarns (in the case of a knitted fabric) may be employed, as the present disclosure is not limited in this regard.

Figure 3:
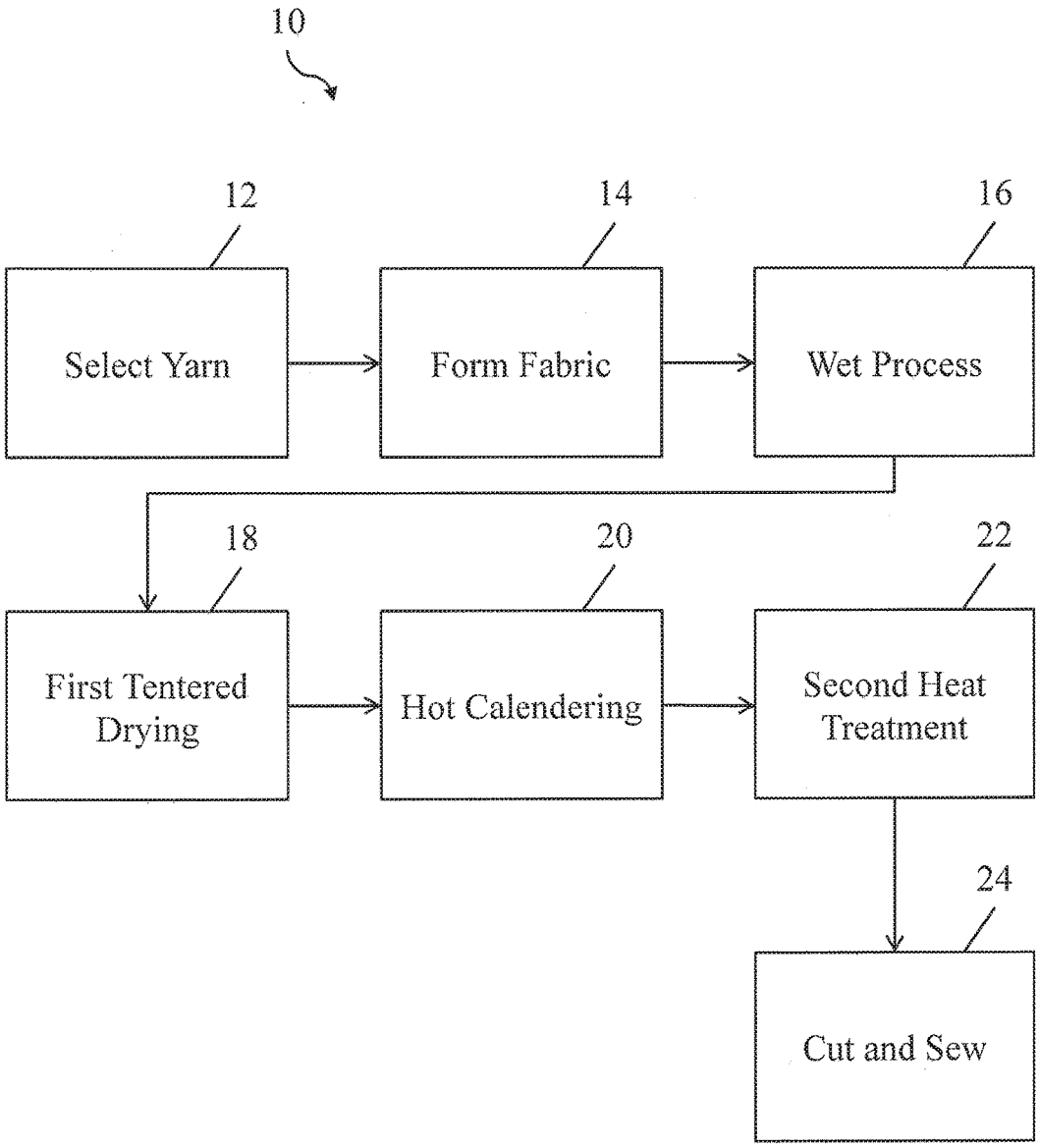
FIG. 3 is a block diagram illustrating one method of forming a fabric.

FIG. 3 is a block diagram 10, which represents an illustrative process used to form an insulating sheer fabric, though aspects disclosed herein are not limited to a specific forming process. One or more yarns are selected at block 12, and the yarns are woven, knitted, or otherwise formed at block 14 to form a fabric. The fabric is wet processed at block 16. In one embodiment, wet processing includes a dying process; dying may be performed with a jig dyeing vessel, a burl dyeing vessel, a jet dyeing vessel, or any other suitable dyeing vessel, as the present disclosure is not limited in this manner. At block 18, the fabric undergoes a first tentered drying process in which the fabric is dried while stretched across a tentering frame. A hot calendaring is performed at block 20 in which the fabric is passed through heated rollers which compress the fabric. It has been discovered that such a hot calendaring process may improve the overall opacity of the fabric and may help in providing a fabric with an even or uniform appearance. The fabric is finished with an additional heat treatment, illustrated as block 22, so that the fabric may maintain an optimal width and finish. The second heat treatment may include a second tentered drying process, or alternatively a contact heat setting. Further, in some embodiments, the process 10 may include a progressive shrinking step, such as sanforization, to add stability to the overall structure of the fabric and to allow the fabric to maintain a desired level of performance after laundering. The finished fabric may then be cut and/or sewn into any desirable size or shape at block 24.

In certain embodiments, an insulting sheer fabric may be formed with nylon yarns included with polyester yarns during an initial weave. The addition of the nylon yarns may improve the initial weight of the fabric, which may in turn improve the thermal insulation properties of the fabric. After the fabric is formed, a portion of the nylon yarns may be selectively removed in desired areas of a fabric through chemical processing to produce a decorative pattern. It should be understood that the fabric remaining after the selective removal of the portion of nylon yarns may still provide a suitable amount of thermal insulation and light transmission.

In addition to allowing a desired level of transmission of visible light, as described above, an insulating sheer fabric also may block transmission of at least a portion of the ultraviolet (UV) radiation, such as UVA and/or UVB radiation with a wavelength between about 290 nm and 400 nm, that is incident on the fabric. Blocking UV radiation may be desirable to protect the interior of a building or other structure from deleterious effects associated with exposure to UV radiation such as fading. In some embodiments, an insulating sheer fabric may block the transmission of between about 65% and 98% of ultraviolet light incident upon the fabric, as measured according to AATCC 183.

Further, in some instances, it may be desirable for an insulating sheer fabric to be reversible such that the fabric has an aesthetic appearance which is substantially the same on both sides of the fabric. Therefore, in some embodiments, an insulating sheer fabric may installed and used in any orientation, and with either side of the fabric facing the interior of the room. In such embodiments, the insulating sheer fabric may have substantially the same construction on both sides of the fabric, and it may not include any coatings or other surface treatments which may alter the aesthetic appearance on one side of the fabric.

EXAMPLE 1

In one non-limiting example, the light transmission and thermal insulation properties of an insulating sheer fabric according to the present disclosure were tested. The properties and performance of the fabric are summarized below in Table 1. The fabric as tested had a weight of 78.65 g/m$^2$ as measured according to ASTM standard D3776, and the fabric weave had a density of 96.0 warp threads per inch and 72.7 filling threads per inch as measured according to ASTM D3775. A 75 denier polyester yarn, as measured according to ASTM D1059, was used for both the warp and filling yarns. The thickness of the fabric was 0.159 cm. The stiffness of the fabric was measured according to ASTM D1388; the average bending length was 2.32 cm when measured parallel to the warp yarns and 2.20 cm when measured parallel to the filling yarns.

Figure 4:
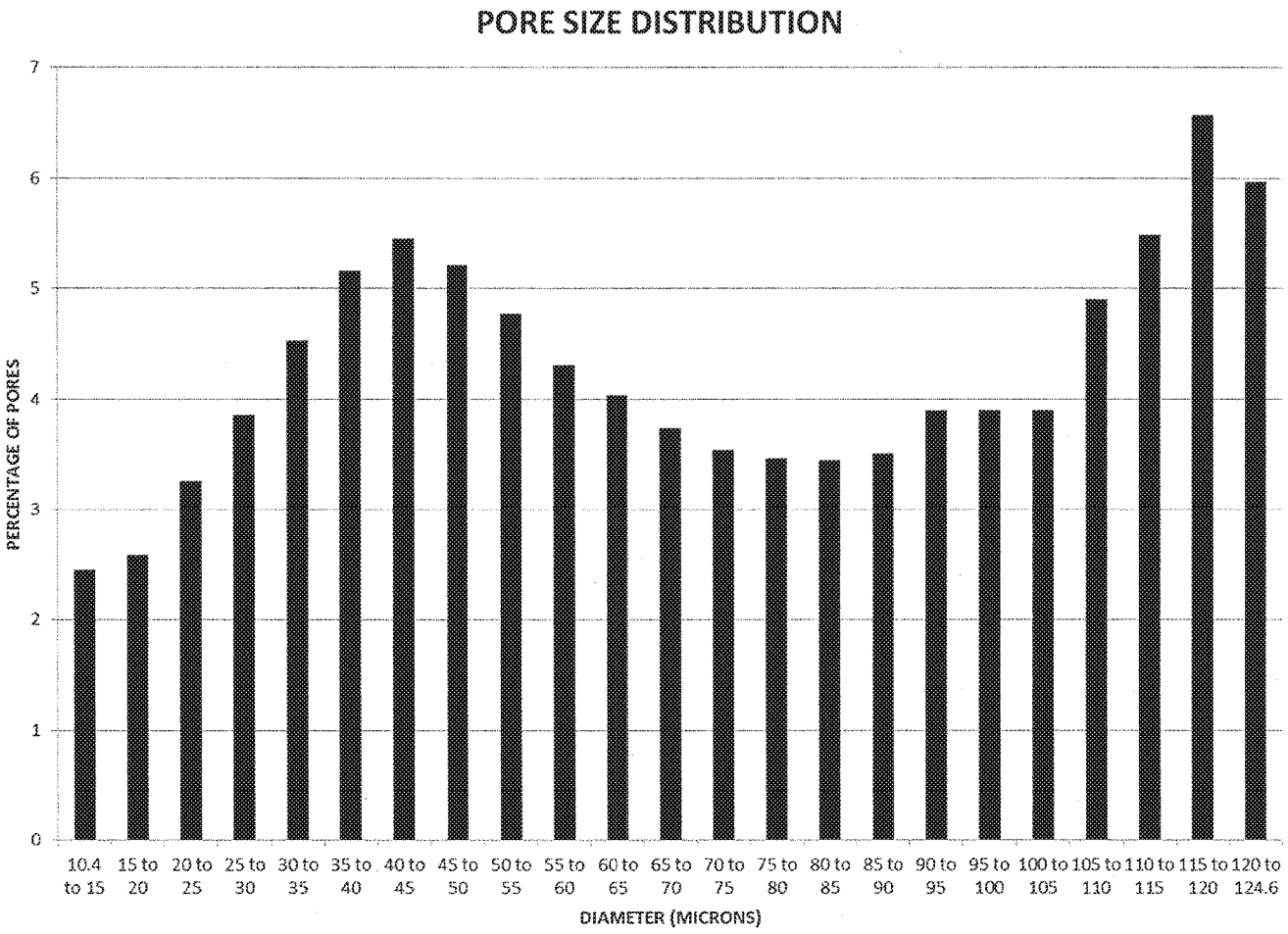
FIG. 4 is a plot of the pore size distribution of an insulating sheer fabric according to one embodiment.

The mean pore size and pore size distribution were measured using a capillary flow analysis. The mean pore size was 68.07 μm with a standard deviation of 45.98 μm. The minimum and maximum pore sizes detected were 10.46 μm and 114.49 μm, respectively. The measured pore size distribution is shown in FIG. 4.

The light transmittance of the insulating sheer fabric was measured according to test method AATCC 203-2014. Light was directed toward a first side of the fabric and the light intensity transmitted through the fabric was measured with a spectrophotometer. The measured light transmittance through the insulating sheer fabric was 60.2% with a standard deviation of 0.29%.

The blocking of ultraviolet radiation with a wavelength between 290 nm and 400 nm was measured according to AATCC 183. The insulating sheer fabric blocked 65.90% of incident UVA radiation and 78.88% of incident UVB radiation.

The thermal insulation performance of the insulating sheer fabric was assessed by performing a thermal transfer test, in which the energy loss in a model enclosure was evaluated both with and without the insulating sheer fabric installed over a window in the enclosure. A six-sided enclosure was constructed using wood 2×4's, foam insulating panels, and sealed with reflective tape. A metal framed, double hung, single pane window was installed within one of the walls of the enclosure, and the insulating sheer fabric was positioned inside the enclosure, 2.375 inches away from the window. A temperature controller and sensor within the model enclosure were used to turn on and off a relay controlling a 1500 W space heater, and a timer was used to measure the amount of time that the heater was turned on; the heater included a small fan to promote air circulation within the enclosure. The interior temperature controller was set to 50° C., and the total "heater on" time was measured over 120 minutes. The "heater on" time was multiplied by the heater power use (1500 W) to obtain the total energy used; lower energy usage indicated less energy lost from the enclosure and therefore improved thermal insulation. The insulating sheer fabric was found to lower the energy usage by 34.9% compared to a baseline test with a window and no window covering. Moreover, the insulating sheer fabric was found to have an R value of 1.08 $K \cdot m^2/W$.

TABLE 1

| Property | Test Method | Value |
|---|---|---|
| Warp Yarn Size | ASTM D1059 | 75 Denier |
| Filling Yarn Size | ASTM D1059 | 75 Denier |
| Weave Density (Warp) | ASTM D3775 | 96 Threads/Inch |
| Weave Density (Filling) | ASTM D3775 | 73 Threads/Inch |
| Fabric Weight | ASTM D3776 | 78.65 $g/m^2$ |
| Fabric Thickness | — | 0.159 cm |
| Bending Length (Warp) | ASTM D1388 | 2.32 cm |
| Bending Length (Filling) | ASTM D1388 | 2.20 cm |
| Mean Pore Size | Capillary Flow | 68.07 μm |
| Std. Dev. Of Pore Size | Capillary Flow | 45.98 μm |
| Minimum Pore Size | Capillary Flow | 10.46 μm |
| Maximum Pore Size | Capillary Flow | 114.49 μm |
| Light Transmittance Mean | AATCC 203-2014 | 60.20% |
| Light Transmittance Std. Dev. | AATCC 203-2014 | 0.29% |
| Blocking of UVA Radiation | AATCC 183 | 65.90% |
| Blocking of UVB Radiation | AATCC 183 | 78.88% |
| Thermal Insulation R Value | Thermal Transfer | 1.08K · $m^2/W$ |

EXAMPLE 2

In another non-limiting example, the light transmission and thermal insulation properties of another insulating sheer fabric according to the present disclosure were tested. The properties and performance of the fabric are summarized below in Table 2. The fabric as tested had weight of 112.82 $g/m^2$ as measured according to ASTM standard D3776, and the fabric weave had a density of 96.0 warp threads per inch and 64.0 filling threads per inch as measured according to ASTM D3775. A 37.8 denier polyester yarn, as measured according to ASTM D1059, was used for the warp yarns, and a 346.9 polyester yarn was used for the filling yarns. The thickness of the fabric was 0.180 cm. The stiffness of the fabric was measured according to ASTM D1388; the average bending length was 3.13 cm when measured parallel to the warp yarns and 3.47 cm when measured parallel to the filling yarns.

Figure 5:
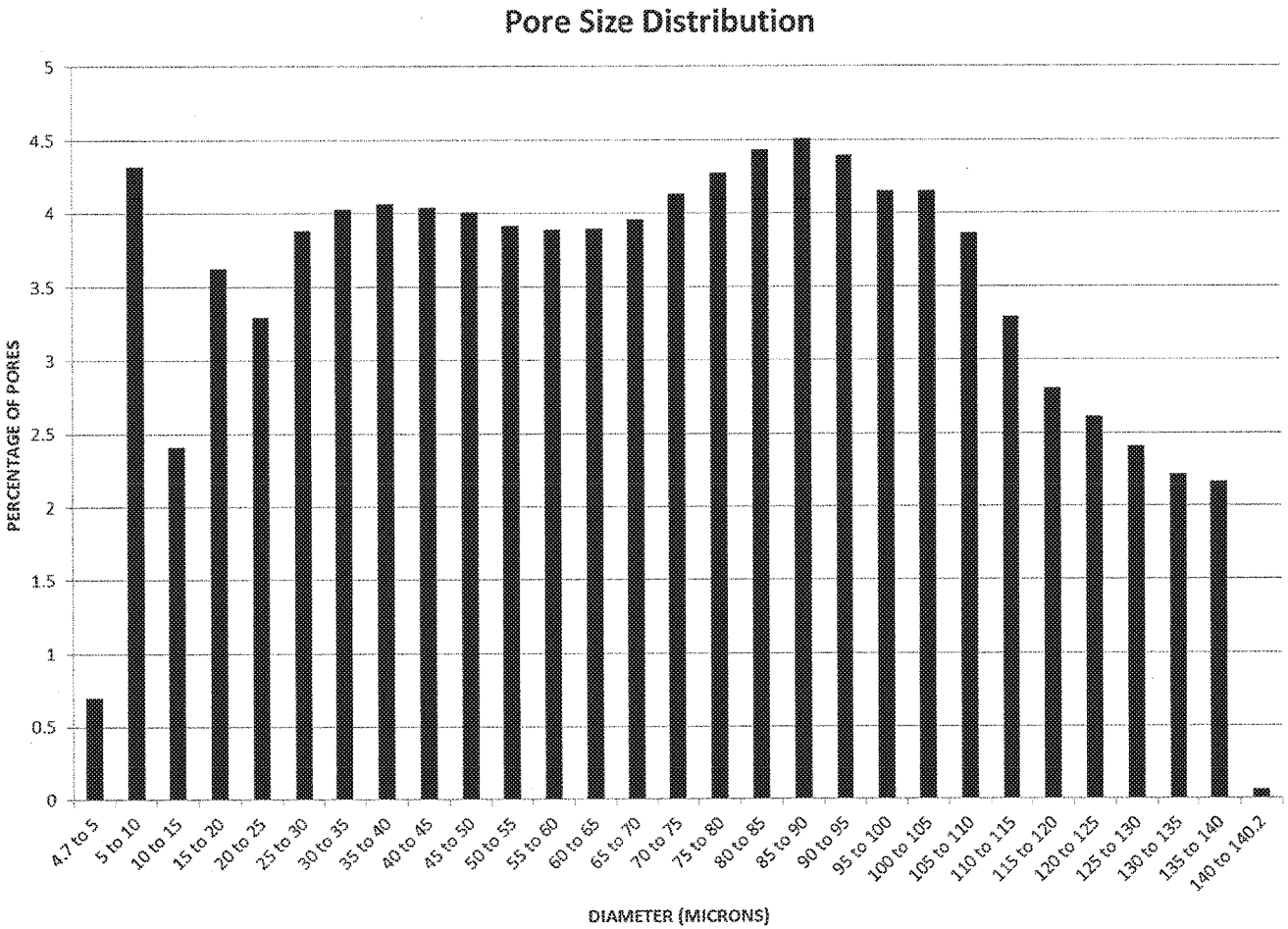
FIG. 5 is a plot of the pore size distribution of an insulating sheer fabric according to one embodiment.

The mean pore size and pore size distribution were measured using a capillary flow analysis. The mean pore size was 69.32 μm with a standard deviation of 55.73 μm. The minimum and maximum pore sizes detected were 4.70 μm and 140.15 μm, respectively. The measured pore size distribution is shown in FIG. 5.

The light transmittance of the insulating sheer fabric was measured according to test method AATCC 203-2014. Light was directed toward a first side of the fabric and the light intensity transmitted through the fabric was measured with a spectrophotometer. The measured light transmittance through the insulating sheer fabric was 23.72% with a standard deviation of 0.462%.

The blocking of ultraviolet radiation with a wavelength between 290 nm and 400 nm was measured according to AATCC 183. The insulating sheer fabric blocked 79.19% of incident UVA radiation and 97.40% of incident UVB radiation.

The thermal insulation performance of the insulating sheer fabric was assessed by performing a thermal transfer test, in which the energy loss in a model enclosure was evaluated both with and without the insulating sheer fabric installed over a window in the enclosure. A six-sided enclosure was constructed using wood 2×4's, foam insulating panels, and sealed with reflective tape. A metal framed, double hung, single pane window was installed within one of the walls of the enclosure, and the insulating sheer fabric was positioned inside the enclosure, 2.375 inches away from the window. A temperature controller and sensor within the model enclosure were used to turn on and off a relay controlling a 1500 W space heater, and a timer was used to measure the amount of time that the heater was turned on; the heater included a small fan to promote air circulation within the enclosure. The interior temperature controller was set to 50° C., and the total "heater on" time was measured over 120 minutes. The "heater on" time was multiplied by the heater power use (1500 W) to obtain the total energy used; lower energy usage indicated less energy lost from the enclosure and therefore improved thermal insulation. The insulating sheer fabric was found to lower the energy usage by 30.7% compared to a baseline test with a window and no window covering. Moreover, the insulating sheer fabric was found to have an R value of 0.901 $K \cdot m^2/W$.

TABLE 2

| Property | Test Method | Value |
|---|---|---|
| Warp Yarn Size | ASTM D1059 | 37.8 Denier |
| Filling Yarn Size | ASTM D1059 | 346.9 Denier |
| Weave Density (Warp) | ASTM D3775 | 96 Threads/Inch |
| Weave Density (Filling) | ASTM D3775 | 64 Threads/Inch |
| Fabric Weight | ASTM D3776 | 112.82 $g/m^2$ |
| Fabric Thickness | — | 0.180 cm |
| Bending Length (Warp) | ASTM D1388 | 3.13 cm |
| Bending Length (Filling) | ASTM D1388 | 3.47 cm |
| Mean Pore Size | Capillary Flow | 69.32 μm |
| Std. Dev. Of Pore Size | Capillary Flow | 55.73 μm |
| Minimum Pore Size | Capillary Flow | 4.70 μm |
| Maximum Pore Size | Capillary Flow | 140.15 μm |
| Light Transmittance Mean | AATCC 203-2014 | 23.72% |
| Light Transmittance Std. Dev. | AATCC 203-2014 | 0.462% |
| Blocking of UVA Radiation | AATCC 183 | 79.19% |
| Blocking of UVB Radiation | AATCC 183 | 97.40% |
| Thermal Insulation R Value | Thermal Transfer | 0.901K · $m^2/W$ |

It should be appreciated that although embodiments described herein relate to woven fabrics, unless otherwise indicated or specifically claimed, the present disclosure and claims are not limited to woven fabrics, as other suitable processes for forming a fabric may be employed. Accordingly, the fabric may be formed as a continuous web by knitting, knotting, or felting instead of or in addition to weaving. As such, as used herein, the term "continuous web" means a fabric or layer thereof formed by any one of the foregoing processes where the fabric contains pores between the adjacent portions of the yarns, fibers, filaments, threads, etc.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A woven fabric comprising:

warp and filling yarns arranged in a weave pattern, the yarns and weave pattern configured to transmit between about 20% and about 65% of incident light through the fabric, as measured according to AATCC 203-2014, and wherein the weave pattern has a density between about 30 and about 130 warp threads per inch and between about 40 and about 120 filling threads per inch, as measured according to ASTM D3775.

2. The woven fabric of claim 1, wherein the yarns and weave pattern are configured to transmit between about 55% and about 65% of incident light through the fabric, as measured according to AATCC 203-2014.

3. The woven fabric of claim 1, wherein the yarns and weave pattern are configured to provide a thermal insulation R value between about 0.75 $K \cdot m^2/W$ and 1.2 $K \cdot m^2/W$.

4. The woven fabric of claim 1, wherein the woven fabric has a first side and a second side, and the first side and second sides have substantially the same construction.

5. The woven fabric of claim 1, wherein the weave pattern forms a plurality of pores having a mean diameter between about 60 μm and about 80 μm and a standard deviation of the pore diameter between about 40 μm and about 60 μm.

6. The woven fabric of claim 1, wherein the fabric has a weight between about 70 $g/m^2$ and 140 $g/m^2$, as measured according to ASTM D3776.

7. The woven fabric of claim 1, wherein the weave pattern has a density between about 95 and about 110 warp threads per inch and between about 68 and about 75 filling threads per inch, as measured according to ASTM D3775.

8. A woven fabric comprising:

warp and filling yarns arranged in a weave pattern, the yarns and weave pattern configured to transmit between about 20% and about 65% of incident light through the fabric, as measured according to AATCC 203-2014, wherein the weave pattern has a density between about 30 and about 130 warp threads per inch and between about 40 and about 120 filling threads per inch, as measured according to ASTM D3775, and wherein the warp and filling yarns are about 75 denier, as measured according to ASTM D1059.

9. The woven fabric of claim 8, wherein the yarns and weave pattern are configured to transmit between about 55% and about 65% of incident light through the fabric, as measured according to AATCC 203-2014.

10. The woven fabric of claim 8, wherein the yarns and weave pattern are configured to provide a thermal insulation R value between about 0.75 $K \cdot m^2/W$ and 1.2 $K \cdot m^2/W$.

11. The woven fabric of claim 8, wherein the woven fabric has a first side and a second side, and the first side and second sides have substantially the same construction.

12. The woven fabric of claim 8, wherein the weave pattern forms a plurality of pores having a mean diameter between about 60 μm and about 80 μm and a standard deviation of the pore diameter between about 40 μm and about 60 μm.

13. The woven fabric of claim 8, wherein the fabric has a weight between about 70 $g/m^2$ and 140 $g/m^2$, as measured according to ASTM D3776.

14. The woven fabric of claim 8, wherein the fabric has a bending length between about 2.00 cm and about 3.75 cm, as measured according to ASTM D1388.

15. The woven fabric of claim 8, wherein the fabric blocks transmission of between about 65% and 98% of ultraviolet light incident upon the fabric, as measured according to AATCC 183.

16. The woven fabric of claim 8, wherein the weave pattern has a density between about 95 and about 110 warp threads per inch and between about 68 and about 75 filling threads per inch, as measured according to ASTM D3775.

17. A woven fabric comprising:

warp and filling yarns arranged in a weave pattern, the yarns and weave pattern configured to transmit between about 20% and about 65% of incident light through the fabric, wherein the weave pattern has a density between about 30 and about 130 warp threads per inch and between about 40 and about 120 filling threads per inch, as measured according to ASTM D3775, and wherein the fabric has a bending length between about 2.00 cm and about 3.75 cm, as measured according to ASTM D1388.

18. The woven fabric of claim 17, wherein the yarns and weave pattern are configured to transmit between about 55% and about 65% of incident light through the fabric, as measured according to AATCC 203-2014.

19. The woven fabric of claim 17, wherein the yarns and weave pattern are configured to provide a thermal insulation R value between about 0.75 $K \cdot m^2/W$ and 1.2 $K \cdot m^2/W$.

20. The woven fabric of claim 17, wherein the woven fabric has a first side and a second side, and the first side and second sides have substantially the same construction.

21. The woven fabric of claim 17, wherein the weave pattern forms a plurality of pores having a mean diameter between about 60 μm and about 80 μm and a standard deviation of the pore diameter between about 40 μm and about 60 μm.

22. The woven fabric of claim 17, wherein the fabric has a weight between about 70 $g/m^2$ and 140 $g/m^2$, as measured according to ASTM D3776.

23. The woven fabric of claim 17, wherein the fabric blocks transmission of between about 65% and 98% of ultraviolet light incident upon the fabric, as measured according to AATCC 183.

24. The woven fabric of claim 17, wherein the weave pattern has a density between about 95 and about 110 warp threads per inch and between about 68 and about 75 filling threads per inch, as measured according to ASTM D3775.

25. A woven fabric comprising:

warp and filling yarns arranged in a weave pattern, the yarns and weave pattern configured to transmit between about 20% and about 65% of incident light through the fabric, wherein the weave pattern has a density between about 30 and about 130 warp threads per inch and between about 40 and about 120 filling threads per inch, as measured according to ASTM D3775, and wherein the fabric blocks transmission of between about 65% and 98% of ultraviolet light incident upon the fabric, as measured according to AATCC 183.

26. The woven fabric of claim 25, wherein the yarns and weave pattern are configured to transmit between about 55% and about 65% of incident light through the fabric, as measured according to AATCC 203-2014.

27. The woven fabric of claim 25, wherein the yarns and weave pattern are configured to provide a thermal insulation R value between about 0.75 $K \cdot m^2/W$ and 1.2 $K \cdot m^2/W$.

28. The woven fabric of claim 25, wherein the woven fabric has a first side and a second side, and the first side and second sides have substantially the same construction.

29. The woven fabric of claim 25, wherein the weave pattern forms a plurality of pores having a mean diameter between about 60 μm and about 80 μm and a standard deviation of the pore diameter between about 40 μm and about 60 μm.

30. The woven fabric of claim 25, wherein the weave pattern has a density between about 95 and about 110 warp threads per inch and between about 68 and about 75 filling threads per inch, as measured according to ASTM D3775.

* * * * *